US009934729B2

(12) United States Patent
Hong et al.

(10) Patent No.: US 9,934,729 B2
(45) Date of Patent: Apr. 3, 2018

(54) ORGANIC LIGHT-EMITTING DISPLAY PANEL, ORGANIC LIGHT-EMITTING DISPLAY DEVICE, DRIVING CIRCUIT, CONTROLLER, AND DRIVING METHOD

(71) Applicant: LG DISPLAY CO., LTD., Seoul (KR)

(72) Inventors: MooKyoung Hong, Jinhae-si (KR); SangGoo Kwon, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/657,448

(22) Filed: Jul. 24, 2017

(65) Prior Publication Data

US 2018/0033373 A1 Feb. 1, 2018

(30) Foreign Application Priority Data

Jul. 28, 2016 (KR) ..... 10-2016-0096466

(51) Int. Cl.

| | |
|---|---|
| ***G09G 3/30*** | (2006.01) |
| ***G09G 3/3258*** | (2016.01) |
| ***G09G 3/3233*** | (2016.01) |
| ***G09G 3/325*** | (2016.01) |

(52) U.S. Cl.

CPC ..... *G09G 3/3258* (2013.01); *G09G 3/325* (2013.01); *G09G 3/3233* (2013.01); *G09G 2300/0861* (2013.01); *G09G 2320/043* (2013.01)

(58) Field of Classification Search

CPC ..... G09G 3/3258; G09G 3/3233; G09G 3/325

USPC ..... 345/207, 158, 102, 690; 315/158, 161

See application file for complete search history.

(56) References Cited

U.S. PATENT DOCUMENTS

| | | | | |
|---|---|---|---|---|
| 2007/0080905 | A1* | 4/2007 | Takahara | G09G 3/3233 345/76 |
| 2009/0141202 | A1* | 6/2009 | Yoshida | G09G 3/3648 349/38 |
| 2011/0069094 | A1* | 3/2011 | Knapp | G09G 3/2003 345/690 |
| 2013/0082615 | A1* | 4/2013 | Williams | H05B 33/0827 315/186 |
| 2016/0283023 | A1* | 9/2016 | Shin | G06F 3/044 |
| 2017/0105265 | A1* | 4/2017 | Sadwick | A61N 5/0618 |

* cited by examiner

*Primary Examiner* — Douglas W Owens
*Assistant Examiner* — Syed M Kaiser
(74) *Attorney, Agent, or Firm* — Morgan, Lewis & Bockius LLP

(57) ABSTRACT

An organic light-emitting display device includes: an organic light-emitting display panel including: a plurality of subpixels including: an organic light-emitting diode (OLED), a driving transistor (DT) driving the OLED including a first transistor between a first node of the DT and a data line, and a second transistor (T2) between a second node of the DT and a reference voltage line having a reference voltage (RV) applied, a sensor, and a sampling switch, wherein, during an OLED short detection period for detecting a short circuit between the first electrode and a second electrode of the OLED: the DT and the first transistor are off, when the T2 is turned off, the RV line is initialized when the RV is applied thereto, after the T2 is turned on, the sampling switch is turned on to connect the sensor and the RV line, and the sensor measures the RV line voltage.

18 Claims, 17 Drawing Sheets

ORGANIC LIGHT-EMITTING DISPLAY PANEL, ORGANIC LIGHT-EMITTING DISPLAY DEVICE, DRIVING CIRCUIT, CONTROLLER, AND DRIVING METHOD

CROSS-REFERENCE TO RELATED APPLICATIONS

This application claims the priority of Korean Application No. 10-2016-0096466, filed on Jul. 28, 2016, the entirety of which is hereby incorporated by reference.

BACKGROUND

1. Technical Field

The present disclosure relates to an organic light-emitting display panel, an organic light-emitting display device, as well as a driving circuit, a controller, and a driving method thereof.

2. Discussion of the Related Art

Organic light-emitting devices, which have come to prominence as next-generation display devices, have inherent merits, such as high response rates, high levels of luminance, and wide viewing angles, because organic light-emitting diodes (OLEDs) that are able to emit light by themselves are used therein.

In organic light-emitting display devices, subpixels including OLEDs are arranged in the form of a matrix, and the levels of brightness of subpixels, selected based on scanning signals, are controlled based on grayscale data. In such organic light-emitting display devices, an area including or between a first electrode and a second electrode of an OLED may be exposed to impurities or moisture during the fabrication process, either before or after the shipment of the device.

In such a case, the OLED may not act properly as a diode, due to an electrical short-circuit occurring between the first electrode and the second electrode. Then, excessive current or abnormal current may flow through the OLED so that the corresponding subpixel may not operate properly. Accordingly, the quality of images produced by the organic light-emitting display device may be significantly lowered.

SUMMARY

Accordingly, the present disclosure is directed to an organic light-emitting display panel, an organic light-emitting display device, a driving circuit, a controller, and a driving method that substantially obviate one or more of the issues due to limitations and disadvantages of the related art.

In one aspect, embodiments of the present disclosure may be able to detect a short circuit occurring between a first electrode and a second electrode of an organic light-emitting diode (OLED).

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided an organic light-emitting display device, comprising: an organic light-emitting display panel comprising: a plurality of data lines; a plurality of gate lines; a plurality of subpixels at respective intersections of the plurality of data lines and the plurality of gate lines, each of the plurality of subpixels comprising: an organic light-emitting diode (OLED); a driving transistor driving the OLED comprising: a first node for a data voltage to be applied; a second node electrically connected to a first electrode of the OLED; and a third node for a driving voltage to be applied though a driving voltage line; a first transistor electrically connected between the first node of the driving transistor and a corresponding data line among the plurality of data lines; and a second transistor electrically connected between the second node of the driving transistor and a reference voltage line to which a reference voltage is applied, a sensor configured to measure a voltage of the reference voltage line; and a sampling switch electrically connected between the reference voltage line and the sensor, wherein, during an OLED short detection period in which a short circuit occurring between the first electrode and a second electrode of the OLED is detected: the driving transistor and the first transistor are configured to be in an off state, in a state in which the second transistor is turned off, the reference voltage line is configured to be initialized in response to the reference voltage being applied thereto, after the reference voltage line is initialized, after a predetermined amount of time has elapsed after the second transistor is turned on, the sampling switch is configured to be turned on to electrically connect the sensor and the reference voltage line, and the sensor is configured to measure the voltage of the reference voltage line.

In another aspect, there is provided an organic light-emitting display panel, comprising: a plurality of data lines; a plurality of gate lines; a plurality of subpixels at respective intersections of the plurality of data lines and the plurality of gate lines, each of the plurality of subpixels comprising: an organic light-emitting diode (OLED); a driving transistor driving the OLED comprising: a first node for a data voltage to be applied; a second node electrically connected to a first electrode of the OLED; and a third node for a driving voltage to be applied though a driving voltage line; a first transistor electrically connected between the first node of the driving transistor and a corresponding data line among the plurality of data lines; and a second transistor electrically connected between the second node of the driving transistor and a reference voltage line to which a reference voltage is applied, wherein, during an OLED short detection period in which a short circuit occurring between the first electrode and a second electrode of the OLED is detected: the driving transistor and the first transistor are configured to be in an off state, in a state in which the second transistor is turned off, the reference voltage line is configured to be initialized in response to the reference voltage being applied thereto, after the reference voltage line is initialized, after a predetermined amount of time has elapsed after the second transistor is turned off, the second transistor is turned on.

In another aspect, there is provided a driving circuit for driving an organic light-emitting display panel comprising a plurality of subpixels, comprising an organic light-emitting emitting diode (OLED) including first and second electrodes and a driving transistor for driving the OLED, the driving circuit comprising: a first circuit configured to output a first data voltage to a data line during a first period and a second data voltage to the data line during a second period different from the first period; a second circuit configured to output a driving voltage having a first driving voltage value to a driving voltage line electrically connected to a drain node or a source node of the driving transistor during the first period and the driving voltage having a second driving voltage value lower than the first driving voltage value to the driving voltage line during the second period; a third circuit configured to output a base voltage applied to the second electrode of the OLED as a first base voltage value during the first period and the base voltage having a second base voltage value higher than the first base voltage value during the second period; and a fourth circuit configured to output a reference voltage having a voltage value lower than the second base voltage value to a reference voltage line during the second period, the reference voltage line being connectable to the source node or the drain node of the driving transistor though other transistors.

In another aspect, there is provided a method of driving an organic light-emitting display device comprising an organic light-emitting display panel comprising a plurality of subpixels defined by intersections of a plurality of data lines and a plurality of gate lines, the method comprising: initializing a reference voltage line by: turning off: a driving transistor driving an organic light-emitting diode (OLED) of a subpixel; a first transistor electrically connected between a first node of the driving transistor and a data line among the plurality of data lines; and a second transistor electrically connected between a second node of the driving transistor and the reference voltage line; and applying a reference voltage to the reference voltage line; turning on the second transistor after initializing the reference voltage line; and measuring a voltage of the reference voltage line after a predetermined amount of time has elapsed after the second transistor is turned on.

In another aspect, there is provided a controller for controlling driving of an organic light-emitting display panel, the controller comprising: a first driving controller, in a state in which a driving transistor driving an organic light-emitting diode (OLED) of a subpixel, the first driving controller comprising: a first transistor electrically connected between a first node of the driving transistor and a data line; and a second transistor electrically connected between a second node of the driving transistor and the reference voltage line are turned off, wherein the first driving controller is configured to control a reference voltage line to be initialized to a reference voltage; a second driving controller configured to control the second transistor to be turned on after the reference voltage line is initialized; and a third driving controller configured to control a voltage of the reference voltage line to be measured when a predetermined amount of time has elapsed after the second transistor is turned on.

In another aspect, there is provided an organic light-emitting display device, comprising: an organic light-emitting display panel comprising: a plurality of data lines; a plurality of gate lines; a plurality of subpixels at respective intersections of the plurality of data lines and the plurality of gate lines; a data driver configured to drive the plurality of data lines; and a gate driver configured to drive the plurality of gate lines, wherein each of the plurality of subpixels comprises: an organic light-emitting diode (OLED), a driving transistor driving the OLED comprising: a first node for a data voltage to be applied, a second node electrically connected to a first electrode of the OLED, and a third node for a driving voltage to be applied though a driving voltage line, a first transistor electrically connected between the first node of the driving transistor and a corresponding data line among the plurality of data lines, and a second transistor electrically connected between the second node of the driving transistor and a reference voltage line to which a reference voltage is applied, wherein the driving voltage has: a first driving voltage value during a first period, and a second driving voltage value lower than the first driving voltage value during a second period different from the first period, a base voltage has: a first base voltage value during the first period, and a second base voltage value higher than the first base voltage value during the second period, and the reference voltage has a voltage value lower than the second base voltage value during the second period.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain various principles of the disclosure.

Figure 1:
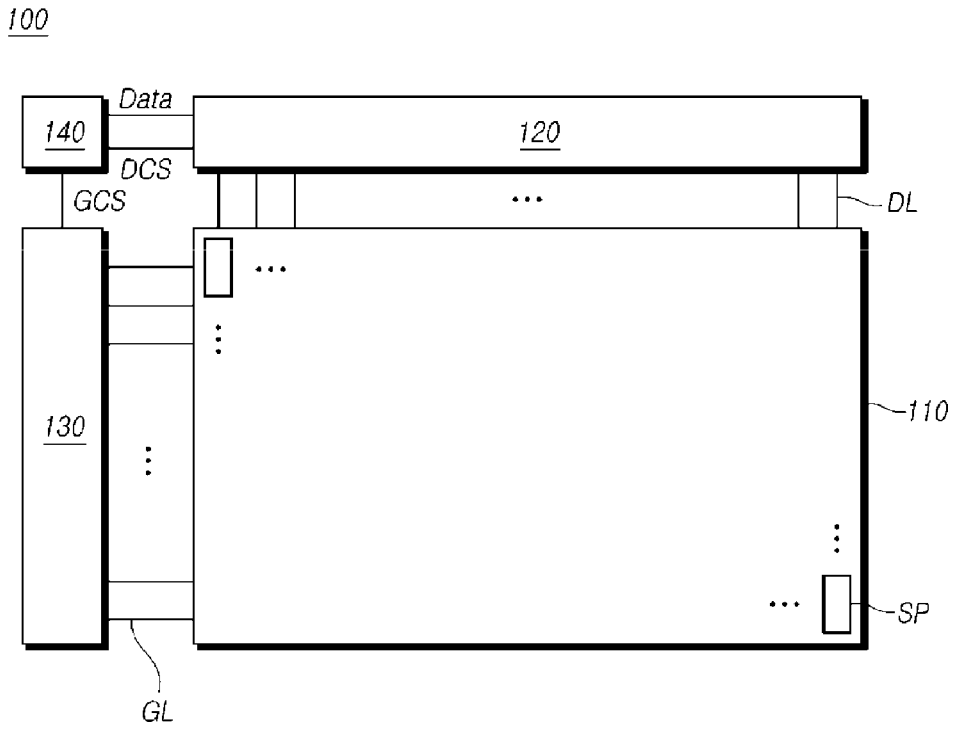
FIG. 1 is a system block diagram illustrating an organic light-emitting display device according to an example embodiment.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to some embodiments of the present disclosure, examples of which are illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

FIG. 1 is a system block diagram illustrating an organic light-emitting display device 100 according to an example embodiment.

With reference to FIG. 1, the organic light-emitting display device 100 according to an example embodiment may include an organic light-emitting display panel 110 in which a plurality of data lines DL, a plurality of gate lines GL, and a plurality of subpixels SP defined by the plurality of data lines DL and the plurality of gate lines GL may be arranged, a data driver 120 driving the plurality of data lines DL, a gate driver 130 driving the plurality of gate lines GL, and a controller 140 controlling the gate driver 130, the data driver 120, and the gate driver 130.

The controller 140 may control the data driver 120 and the gate driver 130 by providing various control signals to the data driver 120 and the gate driver 130. The controller 140 may start scanning according to timing realized in each frame, may convert input image data input from an external source into image data matching a data signal form used in the data driver 120, may output the image data, and may control data driving at a proper time in accordance with the scanning.

The controller 140 may be a timing controller used in a common display technology or may be a control device that includes a timing controller to further perform other control functions. The controller 140 may be a component separated from the data driver 120, and may be integrated with the data driver 120 to be a single integrated circuit.

The data driver 120 may drive the plurality of the data lines DL by supplying a data voltage to the plurality of the data lines DL. The data driver 120 may also be referred to as a "source driver." The data driver 120 may include one or more source driver integrated circuits (SDICs) to drive a plurality of data lines. Each of the SDICs may include a shift register, a latch circuit, a digital-to-analog converter (DAC), an output buffer, and the like. In some cases, each of the SDICs may further include an analog-to-digital converter (ADC), and the like.

The gate driver 130 may sequentially drive the plurality of gate lines GL by sequentially providing scan signals to the plurality of gate lines GL. The gate driver 130 may also be referred to as a "scan driver." The gate driver 130 may include one or more gate driver integrated circuits (GDICs). Each of the GDICs may include a shift register, a level shifter, and the like. The gate driver 130 may sequentially provide scan signals having an on-voltage or an off-voltage to the plurality of gate lines GL under control of the controller 140. When a specific gate line is opened by the gate driver 130, the data driver 120 may convert image data received from the controller 140 into an analog data voltage to supply the analog data voltage to the plurality of data lines DL.

The data driver 120 may be disposed only on one side (for example, an upper side or a lower side) of the organic light-emitting display panel 110 as shown in the FIG. 1 example, or may be disposed on both sides (for example, the upper side and the lower side) of the organic light-emitting display panel 110 in some examples. The gate driver 130 may be disposed only on one side (for example, a left side or a right side) of the organic light-emitting display panel 110 as shown in the FIG. 1 example, or may be disposed on both sides (for example, the left side and the right side) of the organic light-emitting display panel 110 in some examples. The location of the data driver 120 and gate driver 130 may be determined, for example, according to a driving type, a panel design type, and the like.

The controller 140 may receive various signals from an external source (for example, a host system) together with input image data, various timing signals, including a vertical synchronization signal (Vsync), a horizontal synchronization signal (Hsync), an input data enable (DE) signal, a clock signal (CLK), and the like. To control the data driver 120 and the gate driver 130, the controller 140 may receive the timing signals, such as the vertical synchronization signal (Vsync), the horizontal synchronization signal (Hsync), the input DE signal, and the clock signal (CLK), may generate various control signals, and may output the various generated control signals to the data driver 120 and the gate driver 130. For example, to control the data driver 120 and the gate driver 130, the controller 140 may output various gate control signals (GCSs), including a gate start pulse (GSP), a gate shift clock (GSC), a gate output enable (GOE) signal, and the like.

In one example, the GSP may control an operation start timing of one or more gate driver integrated circuits constituting the gate driver 130. The GSC may be a clock signal commonly input to one or more gate driver integrated circuits, and may control a shift timing of a scan signal (gate pulse). The GOE signal may designate timing information of one or more gate driver integrated circuits.

In addition, to control the data driver 120, the controller 140 may output various data control signals (DCS), including a source start pulse (SSP), a source sampling clock (SSC), a source output enable (SOE) signal, and the like. In one example, the SSP may control a data sampling start timing of one or more source driver integrated circuits constituting the data driver 120. The SSC may be a clock signal controlling a sampling timing of data in each of the source driver integrated circuits. The SOE signal may control an output timing of the data driver 120.

Each of the subpixels SP arranged in the organic light-emitting display panel 110 may include circuit elements, such as a self-emission element, e.g., an organic light-emitting diode (OLED) and a driving transistor for driving the OLED. The type and the number of the circuit elements constituting each of the subpixels SP may be variously determined according to a provided function, a design type, and the like.

Figure 2:
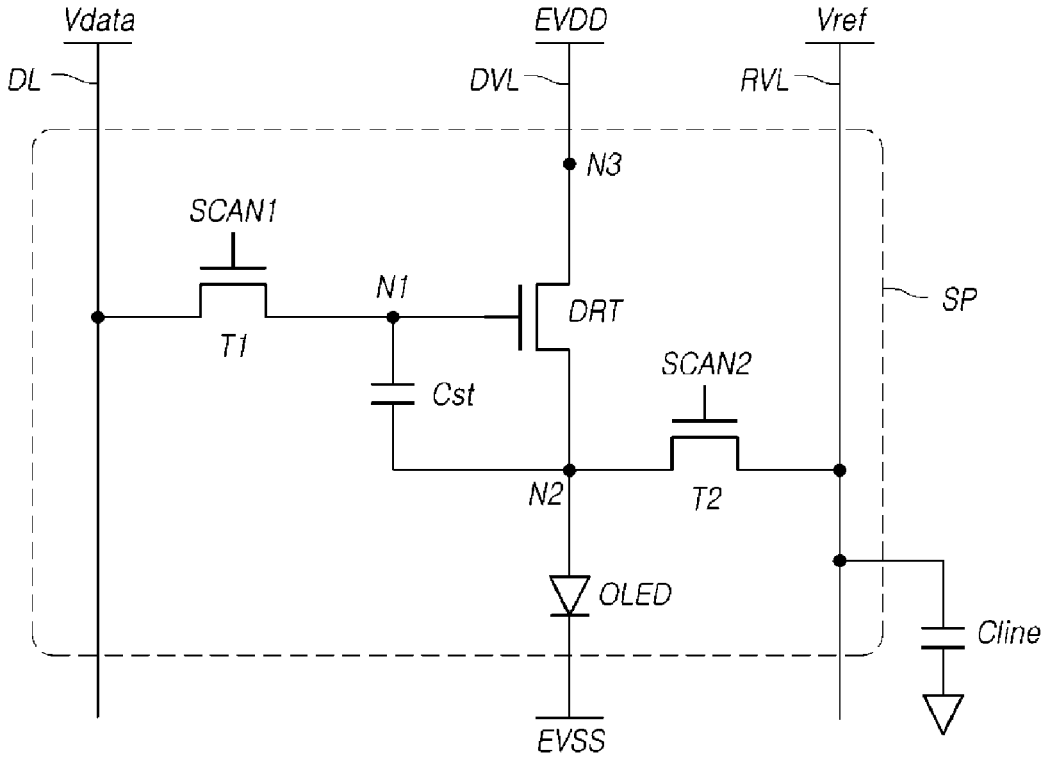
FIG. 2 is a circuit diagram illustrating a subpixel structure of an organic light-emitting display device according to an example embodiment.

FIG. 2 is a circuit diagram illustrating a subpixel structure of an organic light-emitting display device according to an example embodiment.

With reference to FIG. 2, an OLED, a driving transistor DRT, a first transistor T1, a second transistor T2, and a storage capacitor Cst may be disposed in each of the subpixels SP. One or more transistors and/or one or more capacitors may be further disposed in each of the subpixels SP.

The OLED may include a first electrode, a second electrode, and an organic emission layer between the first electrode and the second electrode. In one example, the first electrode may be an anode or a cathode, and the second electrode may be a cathode or an anode. Hereinafter, an example in which the first electrode is an anode and the second electrode is a cathode is used for convenience of description, although embodiments are not limited thereto.

The driving transistor DRT may be a transistor for supplying a driving current Ioled (see FIG. 3) to the OLED to drive the OLED. The driving transistor DRT may be electrically connected to a first node N1 corresponding to a gate node to which a data voltage Vdata may be applied, a second node N2 electrically connected to the first electrode of the OLED, and a third node N3 to which a driving voltage EVDD may be applied through a driving voltage line EVDD.

In one example, the first node N1 may be a gate node. The second node N2 may be a source node or a drain node. The third node N3 may be a drain node or a source node. Hereinafter, an example in which the second node N2 is a source node and the third node N3 is a drain node is used for convenience of description, although embodiments are not limited thereto.

The first transistor T1 may be turned on or off under control of a first scan signal SCAN1, and may be electrically connected between the first node N1 of the driving transistor DRT and a data line DL. The first scan signal SCAN1 may have a turn-on level voltage (for example, a high level voltage (VGH) or a low level voltage (VGL)) able to turn on the first transistor T1, or may have a turn-off level voltage (for example, a low level voltage (VGL) or a high level voltage (VGH)) able to turn off the first transistor T1. When the first transistor T1 is turned on by the turn-on level voltage (for example, the high level voltage (VGH) or the low level voltage (VGL)) of the first scan signal SCAN1, the first transistor T1 may transmit a data voltage Vdata applied to the data line DL to the first node N1 of the driving transistor DRT.

The second transistor T2 may be turned on or off under control of a second scan signal SCAN2, and may be electrically connected between the second node N2 of the driving transistor DRT and a reference voltage line RVL to which a reference voltage Vref may be applied. When the second transistor T2 is turned on by a turn-on level voltage (for example, a high level voltage of the second scan signal SCAN2), the second transistor T2 may transmit the reference voltage Vref applied to the reference voltage line RVL to the second node N2 of the driving transistor DRT.

The second scan signal SCAN2 may have a turn-on level voltage (for example, a high level voltage (VGH) or a low level voltage (VGL)) able to turn on the second transistor T2 or may have a turn-off level voltage (for example, a low level voltage (VGL) or a high level voltage (VGH)) able to turn off the second transistor T2. In addition, when the second transistor T2 is turned on by the turn-on level voltage (for example, the high level voltage (VGH) or the low level voltage (VGL)) of the second scan signal SCAN2, the second transistor T2 may transmit a voltage of the second node N2 of the driving transistor DRT to the reference voltage line RVL. That is, when the second transistor T2 is turned on, the second transistor T2 may function to allow the second node N2 of the driving transistor DRT and the reference voltage line RVL to reach an equipotential state.

The first scan signal SCAN1 and the second scan signal SCAN2 may be different gate signals, respectively. In one example, the first scan signal SCAN1 and the second scan signal SCAN 2 may be respectively applied to a gate node of the first transistor T1 and a gate node of the second transistor T2 through different gate lines.

The first scan signal SCAN1 and the second scan signal SCAN2 may be the same gate signal in some cases. In one example, the first scan signal SCAN1 and the second scan signal SCAN 2 may be commonly applied to the gate node of the first transistor T1 and the gate node of the second transistor T2 through the same gate line.

A storage capacitor Cst electrically connected between the first node N1 and the second node N2 of the driving transistor DRT may be further disposed in each of the subpixels SP. The storage capacitor Cst may function to maintain a voltage for displaying an image during one frame in a state of being charged with the voltage. As a result, although a corresponding row may be turned off and subsequent rows may be sequentially selected, the driving transistor DRT may continuously supply the driving current Ioled to the OLED to allow a corresponding subpixel to emit light during one frame.

The storage capacitor Cst may be an external capacitor intentionally designed outside of the driving capacitor DRT, rather than a parasitic capacitor (for example, Cgs or Cgd), or may be an internal capacitor between the first node N1 and the second node N2 electrically connected to the driving capacitor DRT. Each of the driving capacitor DRT, the first transistor T1, and the second transistor T2 may be an n-type or a p-type transistor.

One reference voltage line RVL may be disposed for every one subpixel row or two or more subpixel rows. In addition, a line capacitor Cline may be disposed in each reference voltage line RVL. The line capacitor Cline may be charged with an electric charge having a level corresponding to a voltage of the reference voltage line RVL, and may be charged or discharged according to a state of a peripheral circuit.

Figure 3:
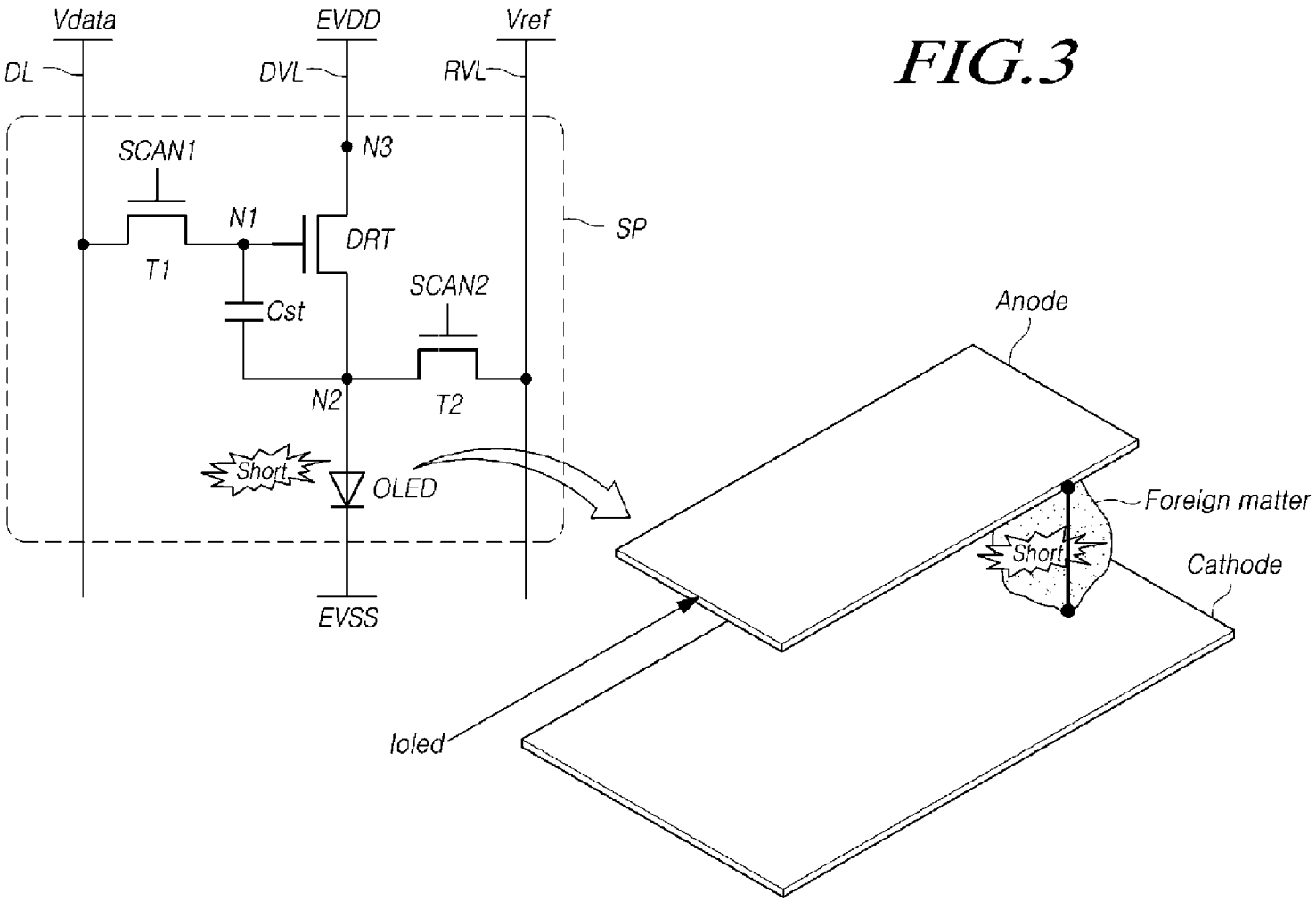
FIG. 3 is a diagram illustrating a short circuit phenomenon of an organic light-emitting diode (OLED) of a subpixel in an organic light-emitting display device according to an example embodiment.

FIG. 3 is a diagram illustrating a short circuit phenomenon of an OLED of a subpixel in an organic light-emitting display device according to an example embodiment.

Foreign matter or moisture may be located between the first electrode and the second electrode of the OLED before or after product shipment. In this case, the OLED may not function properly as a diode due to an electrical short circuit generated between the first electrode and the second electrode. As described above, when a short circuit has occurred between the first electrode and the second electrode, it is said that the OLED is "short-circuited."

When a short circuit has occurred in the OLED, an over-current or an abnormal current flows into the OLED. Thus, a corresponding subpixel may not operate normally. Therefore, image quality of the organic light-emitting display device 100 may be considerably reduced.

The organic light-emitting display device 100 according to an example embodiment may detect an OLED short circuit. In addition, the organic light-emitting display device 100 according to an example embodiment may store and update position information of a subpixel in which an OLED short circuit is detected.

The organic light-emitting display panel 110 may be repaired by using the position information of the subpixel in which the OLED short circuit is detected. Hereinafter, a method of detecting an OLED short circuit and a circuit configuration for the same will be described in more detail.

Figure 4:
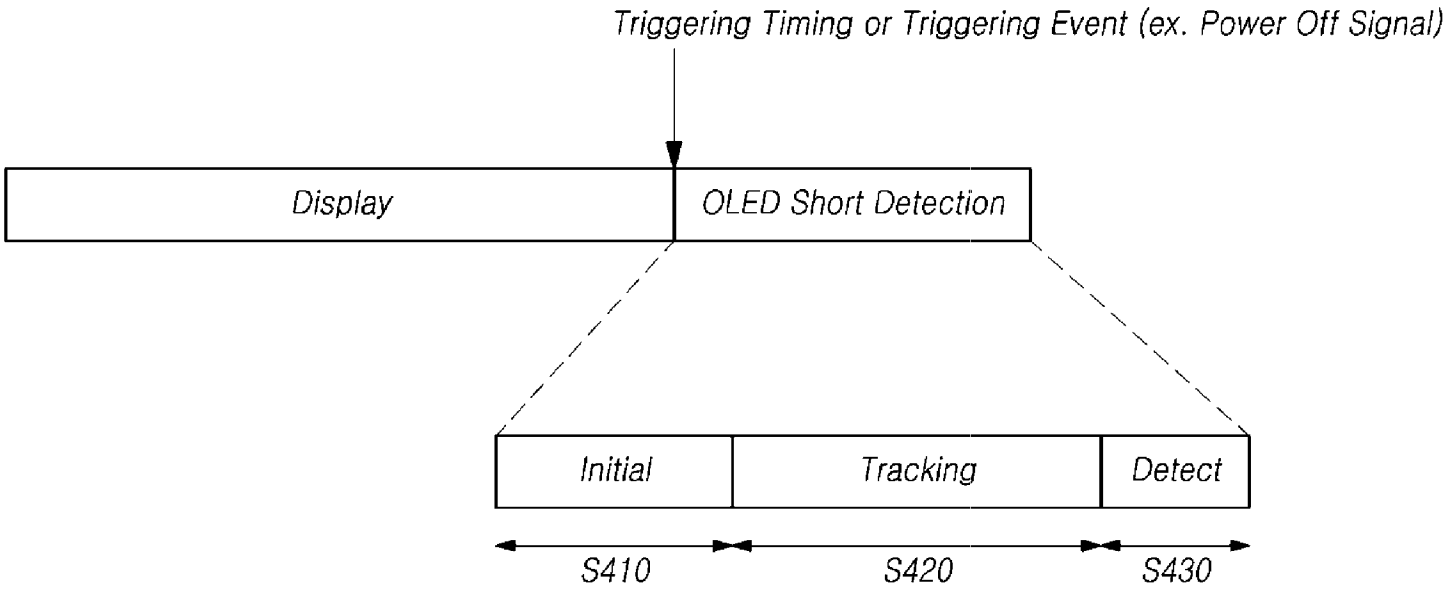
FIG. 4 is a timing diagram of a display section and an OLED short detection section of an organic light-emitting display device according to an example embodiment.

FIG. 4 is a timing diagram of a display section and an OLED short detection section of an organic light-emitting display device according to an example embodiment.

With reference to FIG. 4, the organic light-emitting display device 100 according to an example embodiment may operate in a display mode for displaying an image or may operate in an OLED short detection mode for OLED short detection when a determined triggering timing arrives or when a determined triggering event occurs.

For example, the OLED short detection mode may be triggered by a power-off signal according to a user input or the like. That is, when the organic light-emitting display device 100 operates in the OLED short detection mode, the OLED short detection section (or time period) may proceed according to generation of the power-off signal.

As described above, as the OLED short detection section may proceed after the generation of the power-off signal, it may be possible to perform an OLED detection operation without disturbing the viewing experience of a user. With reference to FIG. 4, the OLED short detection section may include an initialization section (or time period) S410, a tracking section (or time period) S420, and a detection section (or time period) S430.

The initialization section S410 may be a section in which the reference voltage line RVL may be initialized to a reference voltage Vref having a predetermined voltage value. The tracking section S420 may be a section in which a voltage of the reference voltage line RVL may be allowed to reach a variable state. In the tracking section S420, a voltage state of the reference voltage line RVL, based on which an OLED short circuit is detectable, may be tracked. The detection section S430 may be a section in which a voltage of the reference voltage line RVL may be measured.

It may be determined whether or not a short circuit has occurred in an OLED of a corresponding subpixel SP, based on a voltage value measured in the detection section S430. Hereinafter, a method of detecting an OLED short circuit and a circuit for the same will be described in more detail.

Figure 5:
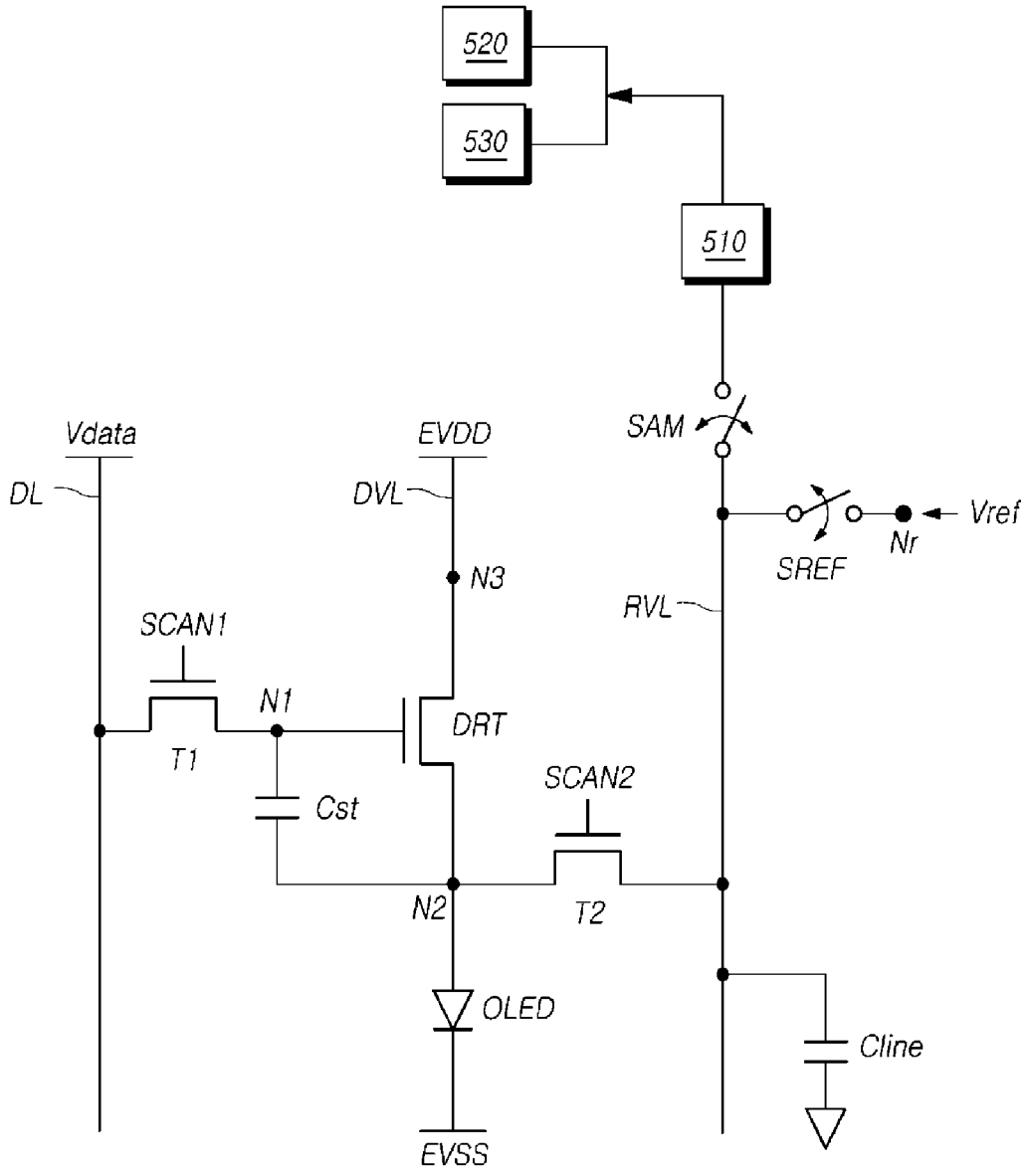
FIG. 5 is a circuit diagram illustrating an OLED short detection circuit of an organic light-emitting display device according to an example embodiment.

FIG. 5 is a circuit diagram illustrating an OLED short detection circuit of an organic light-emitting display device according to an example embodiment.

With reference to FIG. 5, the OLED short detection circuit may include a sensor 510 measuring a voltage of the reference voltage line RVL and a sampling switch SAM electrically connected between the reference voltage line RVL and the sensor 510. For example, the sensor 510 may be an analog-to-digital inverter (ADC). The sensor 510 may be included in a source driver integrated circuit.

During the OLED short detection section in which a short circuit occurring between the first electrode and the second electrode of the OLED is detected, the driving transistor DRT and the first transistor T1 may be in an off state. In addition, during the OLED short detection section, the organic light-emitting display device 100 may operate as follows.

In a state in which the second transistor T2 is turned off, the reference voltage line RVL may be initialized by applying the reference voltage Vref to the reference voltage line RVL (S410). After the reference voltage line RVL is initialized, the second transistor T2 may be turned on, and the process may be paused until a predetermined amount of time has elapsed (S420). When the second transistor T2 is turned on and the predetermined amount of time has elapsed, the sampling switch SAM may be turned on to electrically connect the sensor 510 and the reference voltage line RVL (S430). Therefore, the sensor 510 may measure a voltage of the reference voltage line RVL.

According to the aforementioned method of detecting the OLED short circuit, it may be possible to provide accurate driving able to accurately detect whether the short circuit has occurred in the OLED, without an influence of the driving transistor DRT and the first transistor T1.

With further reference to FIG. 5, the organic light-emitting display device 100 according to an example embodiment may further include a reference voltage supply control switch SREF electrically connected between a reference voltage supply node Nr and the reference voltage line RVL. As described above, according to the method of detecting the OLED short circuit according the exemplary embodiments, in one embodiment, control is performed to supply the reference voltage Vref to the reference voltage line RVL as an initialization voltage and then allow a voltage to vary according to whether the short circuit has occurred in the OLED. Therefore, when the reference voltage supply control switch SREF is used, a voltage state of the reference voltage line RVL can be more accurately controlled.

On the other hand, the organic light-emitting display device 100 according to an example embodiment may further include a detector 520 for detecting whether the short circuit has occurred between the first electrode and the second electrode of the OLED, based on a voltage measurement value. When the detector 520 is used, it may be possible to accurately detect whether the short circuit has occurred in the OLED by using a voltage measurement value obtained according to driving for OLED short detection.

In addition, the organic light-emitting display device 100 according to an example embodiment may further include a memory 530 for storing a detection result of the detector 520 and information related to the detection result. The memory 530 may further store a voltage output value (e.g., a digital value) output from the sensor 510.

Figure 6:
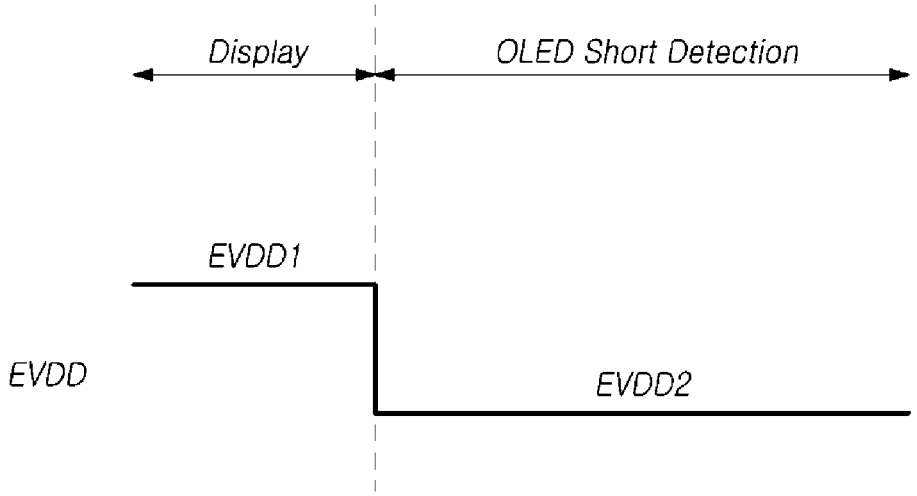
FIG. 6 is a diagram illustrating a driving voltage in each of a display section and an OLED short detection section of an organic light-emitting display device according to an example embodiment.
Figure 7:
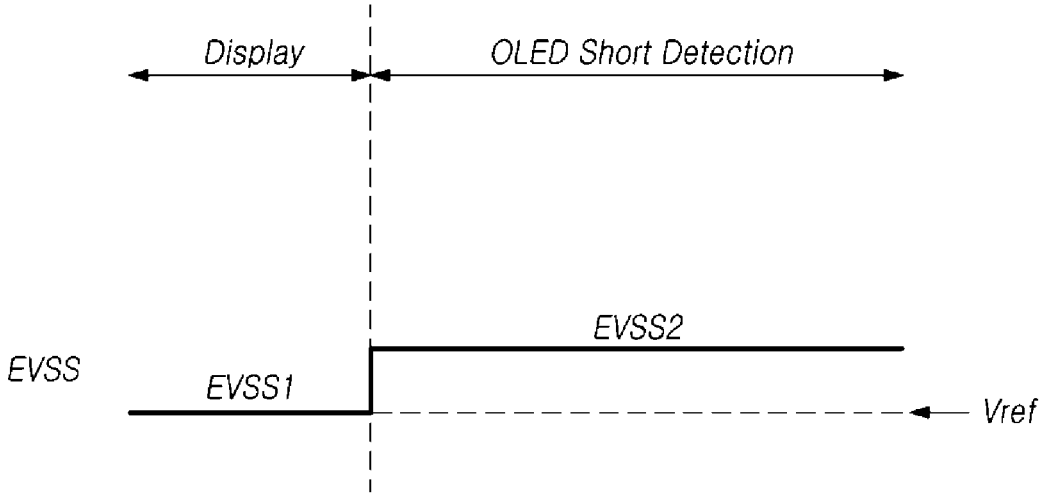
FIG. 7 is a diagram illustrating a base voltage in each of a display section and an OLED short detection section of an organic light-emitting display device according to an example embodiment.

FIG. 6 is a diagram illustrating a driving voltage in each of a display section and an OLED short detection section of an organic light-emitting display device according to an example embodiment. FIG. 7 is a diagram illustrating a base voltage in each of a display section and an OLED short detection section of an organic light-emitting display device according to an example embodiment.

With reference to FIG. 6, the driving voltage EVDD during the OLED short detection section may have a second driving voltage value EVDD2 lower than a first driving voltage value EVDD1 during the display section. The first driving voltage value EVDD1 may be a voltage enabling driving of the OLED by the driving transistor DRT (e.g., turning-on of the driving transistor DRT) and may be, for example, a set value of about 20V or more. The second driving voltage value EVDD2 may be a voltage value disabling driving of the OLED by the driving transistor DRT (e.g., turning-on of the driving transistor DRT) and may be, for example, a set value of about 0V or the like.

With reference to FIG. 7, the base voltage EVSS during the OLED short detection section may have a second base voltage value EVSS2 lower than a first base voltage value EVSS1 during the display section. The first base voltage EVSS1 may be, for example, a low voltage value of about 0 V or the like. The second base voltage value EVSS2 may be higher than the first base voltage value EVSS1, and may be a voltage value high enough to allow a voltage of the second node N2 of the driving transistor DRT when the short circuit has occurred in the OLED. For example, the second base voltage value EVSS may be about 6V to about 7V.

The reference voltage Vref may be a voltage supplied to the reference voltage line RVL, and then not supplied to the reference voltage line RVL during the display section. Therefore, while the second node N2 of the driving transistor DRT is initialized to the reference voltage Vref and then floated to cause a voltage rise thereof, the second node N2 may supply a driving voltage to the OLED.

With reference to FIG. 7, the reference voltage Vref during the OLED short detection section may have a voltage value lower than the second base voltage value EVSS2. In addition, the reference voltage Vref during the OLED short detection section may correspond to a voltage value lower than the second base voltage value EVSS2, and may be set to a voltage value equal to the driving voltage EVDD during the OLED short detection section by taking an off state maintenance, a short circuit phenomenon, and the like, of the driving transistor DRT into account.

During the OLED short detection section, the voltage value of each of the driving voltage EVDD, the base voltage EVSS, and the reference voltage Vref may be set as described above to perform accurate detection. In particular, even when a short circuit has occurred in the driving transistor DRT connected to the second node N2, of which a voltage state may be varied according to the short circuit of the OLED, the short circuit of the OLED may be accurately detected.

Figure 8:
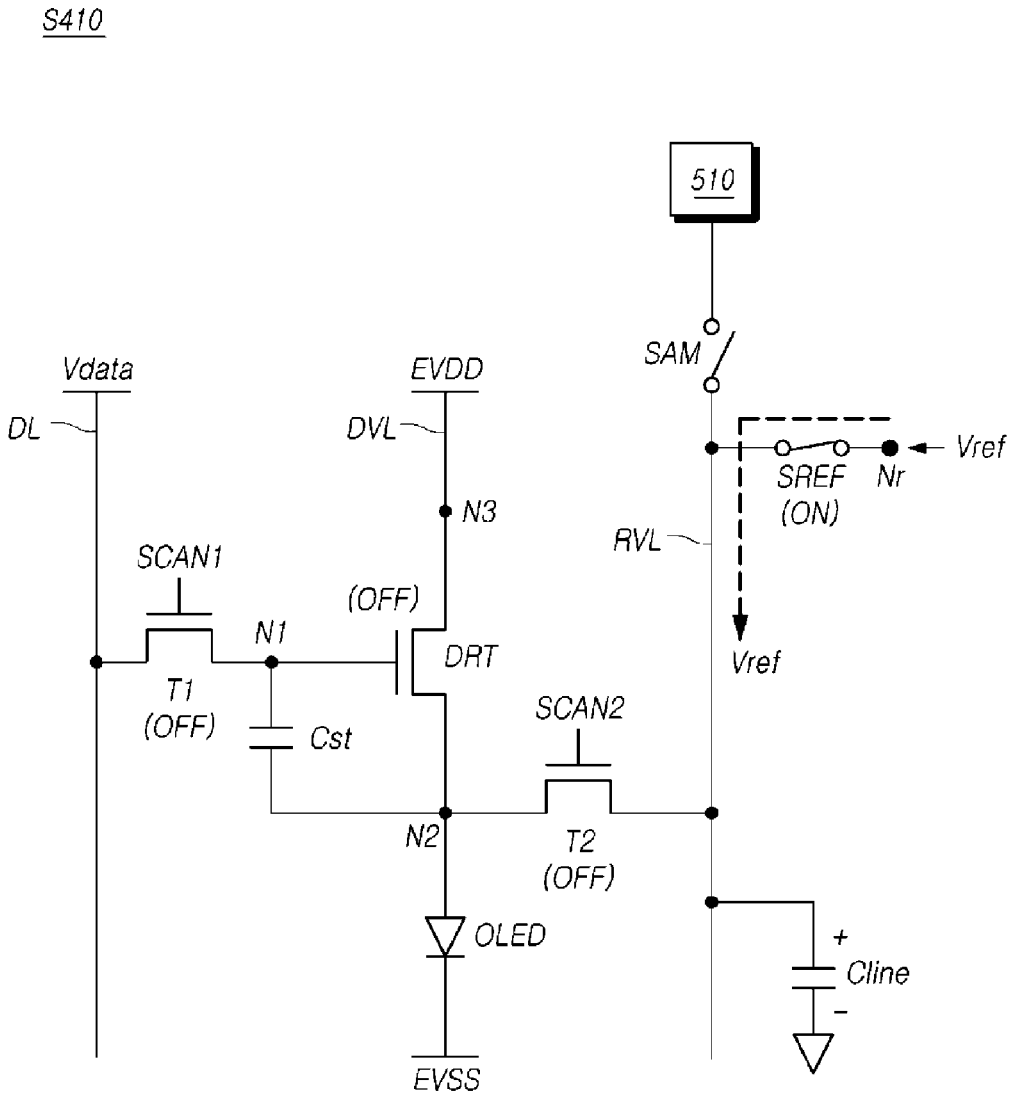
FIGS. 8 to 10 are operation circuit diagrams in an OLED short detection section of an organic light-emitting display device according to example embodiments.
Figure 9:
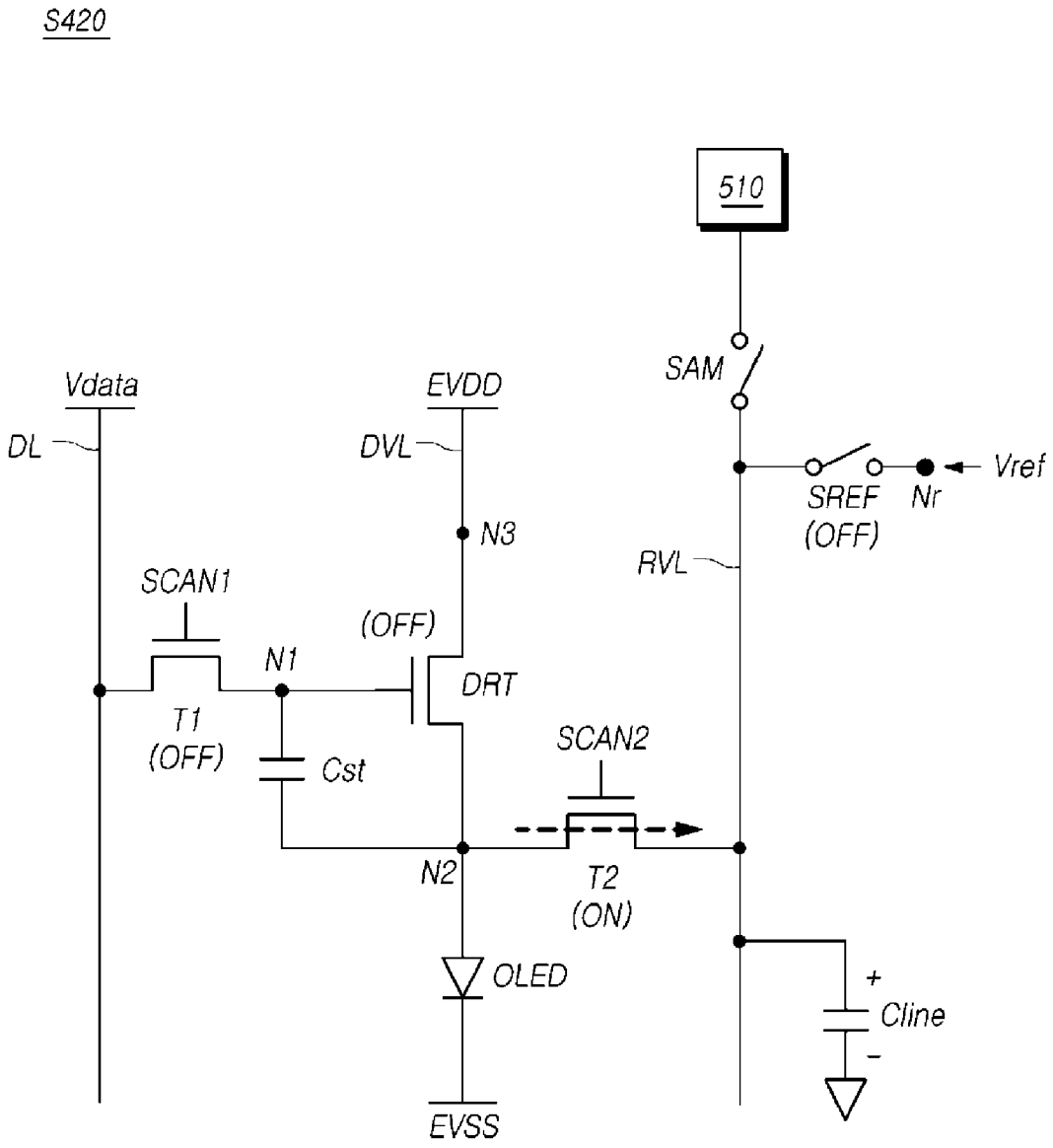
Figure 10:
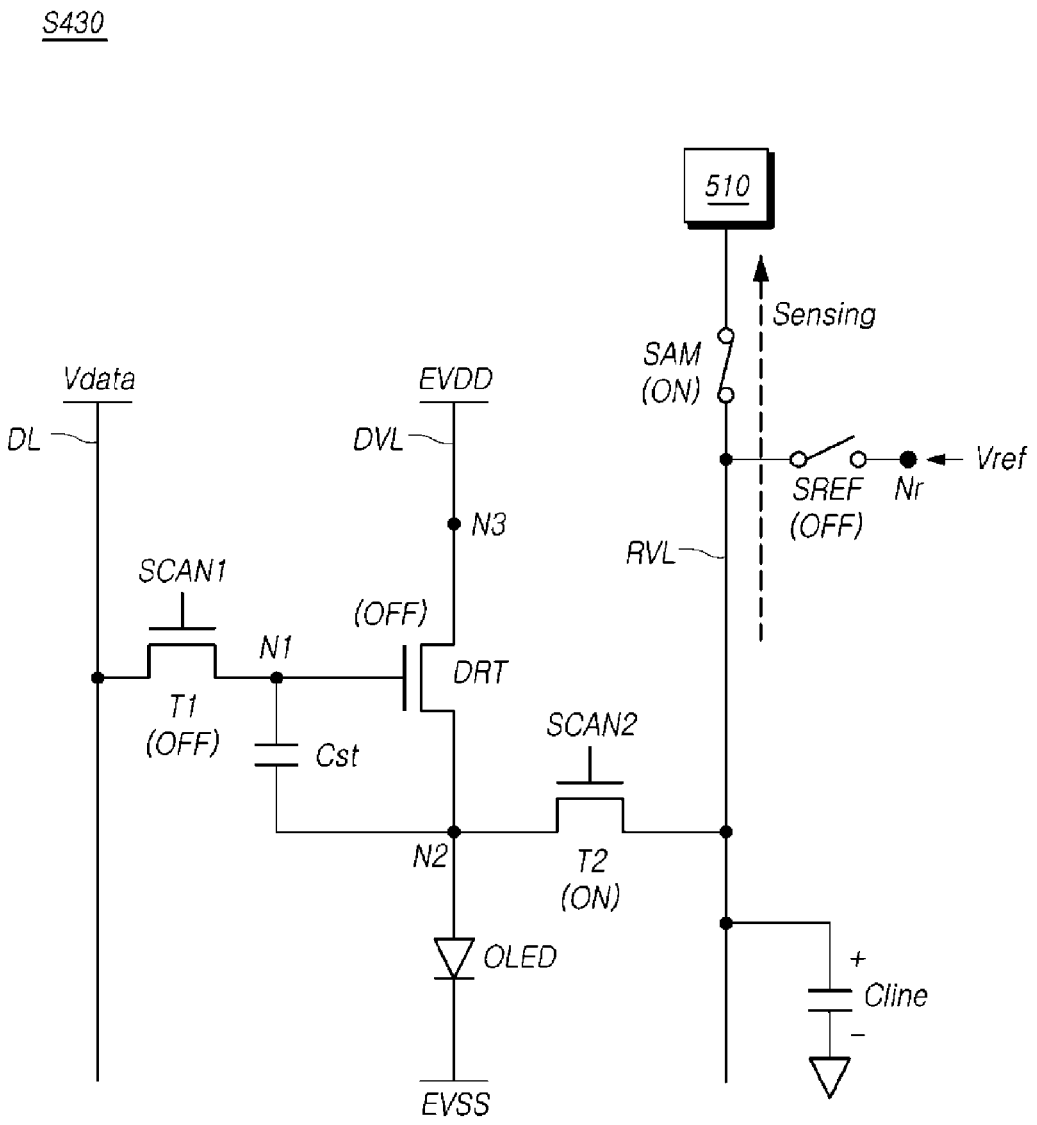
Figure 11:
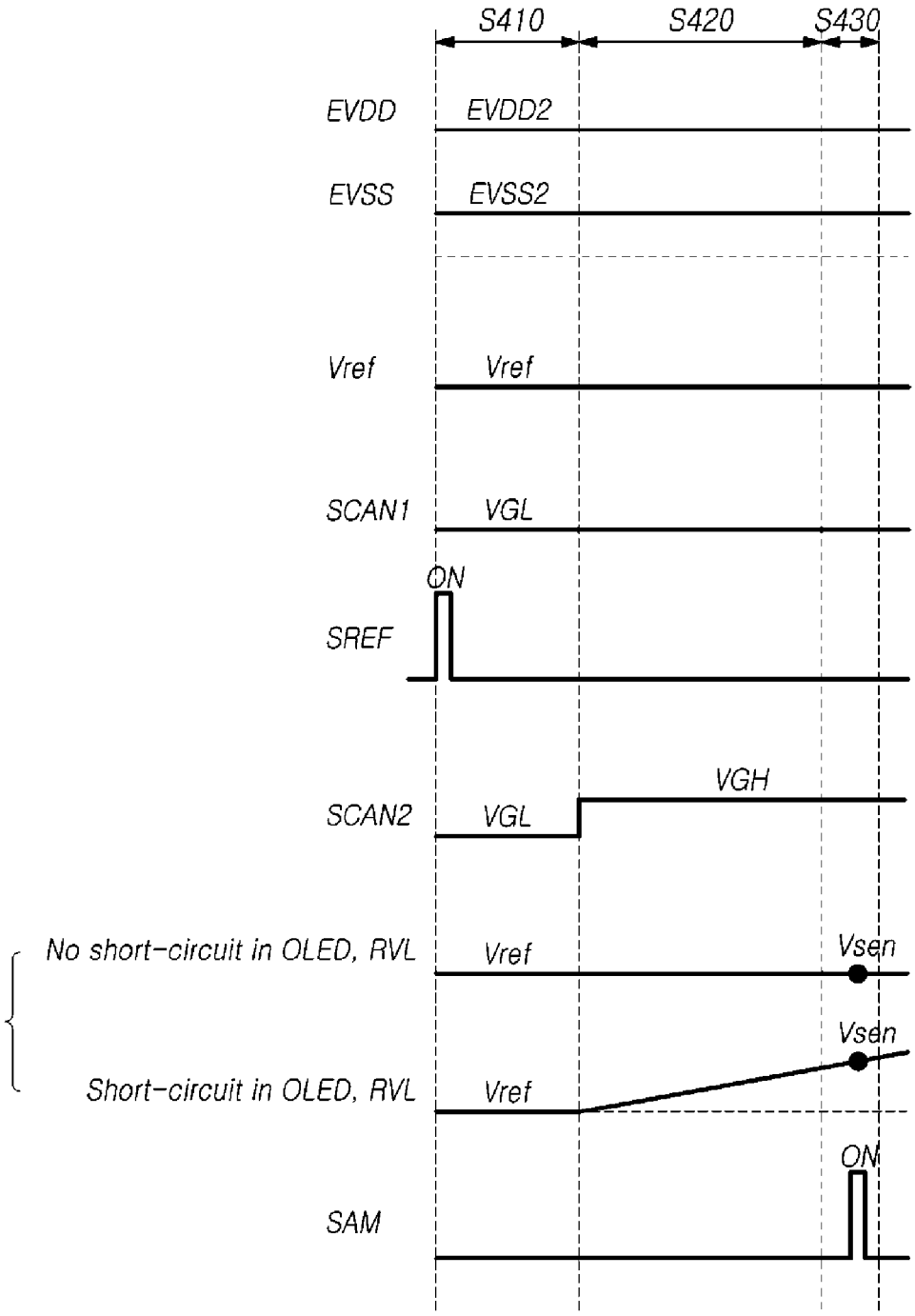
FIG. 11 is an operation timing diagram of an OLED short detection section of an organic light-emitting display device according to an example embodiment.

FIGS. 8 to 10 are operation circuit diagrams in an OLED short detection section of an organic light-emitting display device according to example embodiments. FIG. 11 is an operation timing diagram of an OLED short detection section of an organic light-emitting display device according to an example embodiment.

With reference to FIGS. 8 to 11, the OLED short detection section may be time-divided into an initialization section S410, a tracking section S420, and a detection section S430. With reference to FIGS. 8 to 11, during the initialization section S410, organic light-emitting display device 100 may turn on the reference voltage supply control switch SREF to initialize the reference voltage line RVL to the reference voltage Vref in a state in which the driving transistor DRT, the first transistor T1, and the second transistor T2 are turned off.

The initialization section S410 may start by turning on the reference voltage supply control switch SREF. In the initialization section S410, a driving voltage EVDD applied to the third node N3 of the driving transistor DRT may be the second driving voltage value EVDD2, and a base voltage EVSS applied to the second electrode of the OLED may be the second base voltage value EVSS2. The reference voltage Vref may be a voltage value lower than the second base voltage value EVSS2, and may be a voltage value equal to the second driving voltage value EVDD2.

In addition, in the initialization section S410, the first transistor T1 may be turned off by the first scan signal SCAN1 of the turn-off level voltage, for example, VGL. The second transistor T2 may be turned off by the second scan signal SCAN3 of the turn-off level voltage, for example, the VGL.

In the initialization section S410, for example, a data voltage Vdata of about 0V may be supplied to the data line DL. In the initialization section S410, the reference voltage line RVL may be accurately initialized to the reference voltage Vref, regardless of whether the OLED is short-circuited, by initializing the reference voltage line RVL in a state in which the second transistor T2 is turned off.

With reference to FIGS. 9 and 11, during the tracking section S420, the organic light-emitting display device 100 may turn on the second transistor T2 to maintain the second transistor T2 in a turned-on state for a predetermined amount of time in a state in which the reference voltage supply control switch SREF is turned off.

The tracking section S420 may start by tuning on the second transistor T2. The second transistor T2 may be turned on by the second scan signal SCAN2 of the turn-off level voltage, for example, VGH. During the tracking section S420, because the reference voltage supply control switch SREF may be in a turned-off state, the reference voltage line RVL may be in a state in which a voltage thereof is variable, according to the short circuit of the OLED (e.g., the short circuit between the first electrode and the second electrode). In addition, a voltage of the second node N2 of the driving transistor DRT, e.g., a voltage of the first electrode of the OLED, may be transmitted to the reference voltage line RVL by turning on the second transistor T2.

With reference to FIG. 11, during the tracking section S420, when the short circuit has occurred in the OLED (between the first electrode and the second electrode), a voltage of the reference voltage line RVL electrically connected to the second node N2 of the driving transistor DRT (e.g., the first electrode of the OLED) may be maintained to the reference voltage Vref applied to the reference voltage line RVL in the initialization section S410. Although the voltage of the reference voltage line RVL may vary, a variation range thereof may be small.

During the tracking section S420, when the short circuit has occurred in the OLED (e.g., between the first electrode and the second electrode), a voltage of the first electrode short-circuited with the second electrode of the OLED may be transmitted through the second transistor T2. Thus, a voltage of the reference voltage line RVL electrically connected to the second node N2 of the driving transistor DRT (e.g., the first electrode of the OLED) may vary toward a voltage (e.g., EVSS=EVSS2) of the second electrode of the OLED.

That is, during the tracking section S420 of the OLED short detection section, after the second transistor T2 is turned on, in at least one subpixel SP, a voltage of the reference voltage line RVL may be different from or higher than the reference voltage Vref applied in the initialization section S410, or may deviate from a critical range of the reference voltage Vref. In at least one subpixel, a voltage of the reference voltage line RVL may be equal to the reference voltage Vref, or may be within the critical range of the reference voltage Vref.

Therefore, when only a voltage variation state of the reference voltage line RVL is conformed, the short circuit of the OLED may be accurately and easily detected. When a predetermined amount of time has elapsed after the tracking section S420 proceeds, the detection section S430 may be executed.

With reference to FIGS. 10 and 11, during the detection section S430, the sampling switch SAM may be turned on to electrically connect the sensor 510 and the reference voltage line RVL. Therefore, the sensor 510 connected to the reference voltage line RVL may measure a voltage of the reference voltage line RVL to output a voltage measurement value. Because the sensor 510 may be an ADC, the output voltage measurement value may be a digital value of a measured voltage Vsen. The short circuit of the OLED may be accurately detected according to the aforementioned driving procedure.

With reference to FIG. 11, when the voltage measurement value output from the sensor 510 is equal to a reference voltage Vref corresponding to an initialization voltage of the reference voltage line RVL, or is within a critical range of the reference voltage Vref, the detector 520 may determine that the short circuit has not occurred between the first electrode and the second electrode of the OLED. When the voltage measurement value output by the sensor 510 is different from the reference voltage Vref, is higher than the reference voltage Vref, or deviates from the critical range of the reference voltage Vref, the detector 520 may determine that the short circuit has occurred between the first electrode and the second electrode of the OLED. As described above, the detector 520 may accurately and easily detect the short circuit of the OLED according to voltage variations of the reference voltage line RVL.

On the other hand, when it is determined the short circuit has occurred between the first electrode and the second electrode of the OLED, due to the voltage measurement value being different from the reference voltage Vref, being higher than the reference voltage Vref, or deviating from the critical range of the reference voltage Vref, the detector 520 may store identification information or position information about the subpixel SP, in which the short circuit has occurred between the first electrode and the second electrode of the OLED, in the memory 530. The detector 520 may output a message indicating that the short circuit has occurred between the first electrode and the second electrode of the OLED.

As described above, a position of a defective subpixel, in which a short circuit has occurred in an OLED, may be checked again at a later time. Therefore, repair processing of the defective subpixel may be easier to perform. Hereinafter, a driving circuit and a controller for the aforementioned method of detecting the OLED short circuit will be described in more detail.

Figure 12:
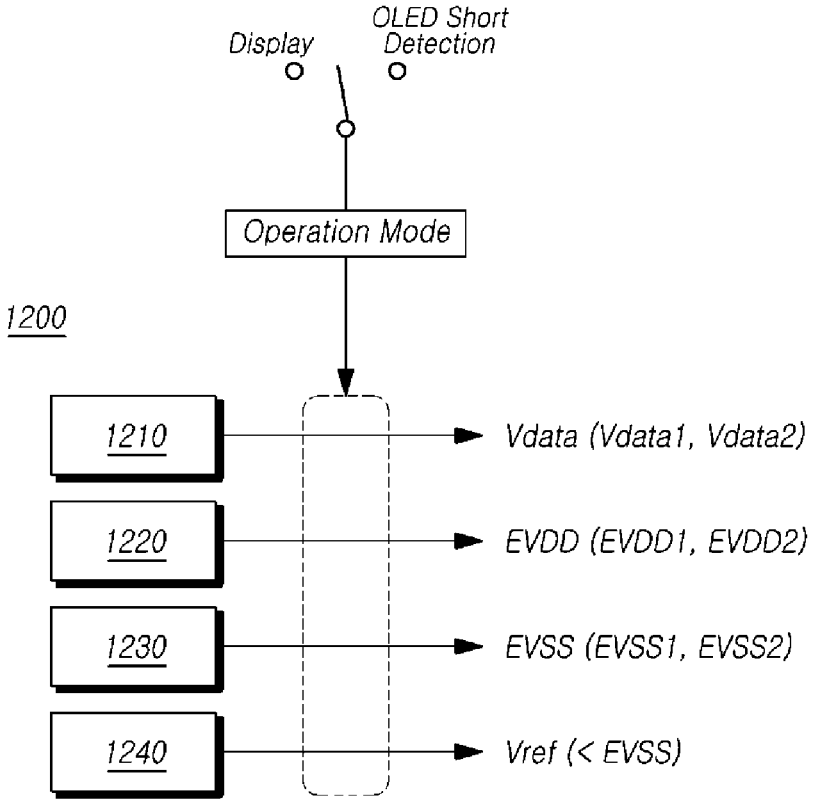
FIG. 12 is a diagram illustrating a driving circuit of an organic light-emitting display device according to an example embodiment.

FIG. 12 is a diagram illustrating a driving circuit of an organic light-emitting display device according to an example embodiment.

With reference to FIG. 12, a driving circuit 1200 of the organic light-emitting display device 100 according to an example embodiment may include a first circuit 1210 outputting a first data voltage Vdata1 during a first section, and a second data voltage Vdata2 during a second section different from the first section; a second circuit 1220 outputting a driving voltage EVDD having a first driving voltage value EVDD1 during the first section, and a driving voltage EVDD having a second driving voltage value EVDD2 lower than the first driving voltage value EVDD1 during the second section different from the first section; a third circuit 1230 outputting a base voltage EVSS having a first base voltage value EVSS1 during the first section, and a base voltage EVSS having a second base voltage value EVSS2 higher than the first base voltage value EVSS1 during the second section; a fourth circuit 1240 outputting a reference voltage Vref having a voltage value lower than the second base voltage value EVSS2 to a reference voltage line RVL during the second section.

The first section above may be a display driving section. The second section may be a driving section in which the short circuit between the first electrode and the second electrode of the OLED may be detected.

Therefore, the first data voltage Vdata1 may correspond to an image signal voltage. The second data voltage Vdata2 may be a data voltage required for OLED short detection, and may be, for example, a voltage (e.g., 0V) for turning off the driving transistor DRT.

Regardless of whether the driving transistor DRT is short-circuited, a voltage value of the reference voltage Vref may be equal to the second driving voltage value EVDD2 such that a voltage of the first electrode of the OLED, e.g., a voltage of the second node N2 the driving transistor DRT, may vary only by whether the OLED is short-circuited. When the driving circuit 1200 and the organic light-emitting display device 100 including the driving circuit 1200 are used, driving for accurate detection of the short circuit of the OLED can be provided.

In addition, when the driving circuit 1200 and the organic light-emitting display device 100 including the driving circuit 1200 are used, display driving and OLED detection driving can be accurately provided. The driving circuit 1200 may be a source driver integrated circuit (IC) corresponding to the data driver 120, or may be included in the source driver IC. In addition, the driving circuit 1200 may include a power controller.

Figure 13:
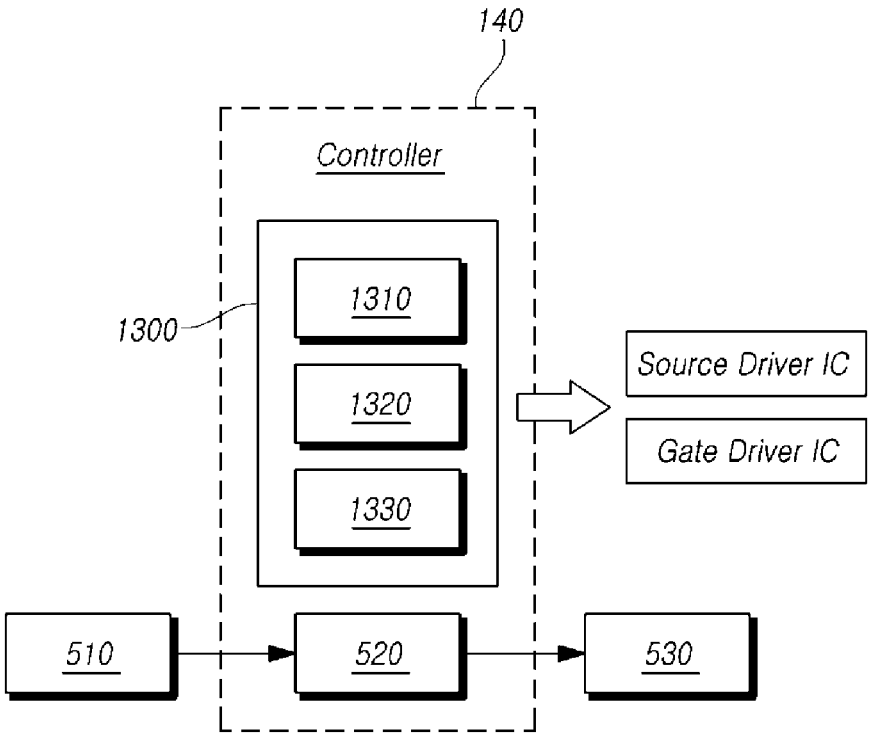
FIG. 13 is a diagram illustrating a controller of an organic light-emitting display device according to an example embodiment.

FIG. 13 is a diagram illustrating a controller of an organic light-emitting display device according to an example embodiment.

With reference to FIG. 13, the controller 140 of the organic light-emitting display device 100 according to an example embodiment may include a source driver IC forming the driving circuit 1200, or may include the driving circuit 1200 and a driving controller 1300 controlling a data driver IC.

The driving controller 1300 may include a first driving controller 1310 controlling a gate driver IC and the source driver IC, such that the reference voltage line RVL may be initialized to the reference voltage Vref in a state in which the first transistor T1 and the second transistor R2 may be turned off; a second driving controller 1320 controlling the gate driver IC and the source driver IC, such that the first transistor T1 and the second transistor R2 may be turned on after the reference voltage line RVL is initialized; and a third driving controller 1330 controlling the source driver IV including the sampling switch SAM and the sensor 510, such that a voltage of the reference voltage line RVL may be measured when a predetermined amount of time has elapsed after the second transistor T2 is turned on. When the aforementioned controller 140 is used, it may be possible to control an OLED short detection operation.

With reference to FIG. 13, the controller 140 of the organic light-emitting display device 100 according to an example embodiment may further include a detector 520 for detecting whether the short circuit has occurred between the first electrode and the second electrode of the OLED, based on the voltage measurement value of the reference voltage line RVL, output from the sensor 510.

When the voltage measurement value is equal to the reference value Vref or is within the critical range of the reference value Vref, the detector 510 may determine that the short circuit has not occurred between the first electrode and the second electrode of the OLED. When the voltage measurement value is different from the reference voltage Vref, is higher than the reference voltage Vref, or deviates from the critical range of the reference voltage Vref, the detector 510 may determine that the short circuit has occurred between the first electrode and the second electrode of the OLED.

When it is determined that the voltage measurement value is different from the reference voltage Vref, is higher than the reference voltage Vref, or deviates from the critical range of the reference voltage Vref, such that the short circuit has been determined to have occurred between the first electrode and the second electrode of the OLED, the detector 520 may store identification information or position information about a subpixel SP, in which the short circuit has occurred between the first electrode and the second electrode of the OLED, in the memory 530, or may output a message indicating that the short circuit has occurred between the first electrode and the second electrode of the OLED.

Figure 14:
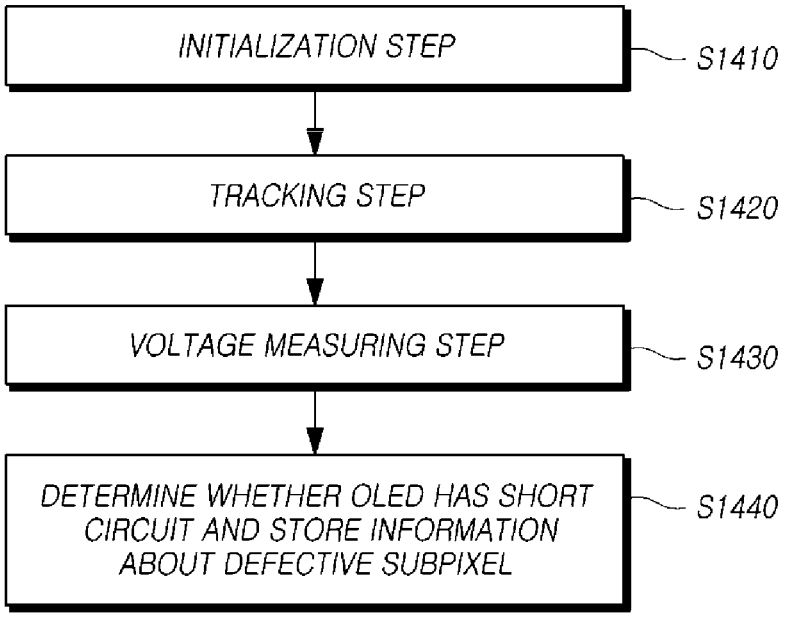
FIG. 14 is a flowchart of a driving method of an organic light-emitting display device according to an example embodiment.

FIG. 14 is a flowchart of a driving method of an organic light-emitting display device according to an example embodiment.

With reference to FIG. 14, the driving method of the organic light-emitting display device 100, according to an example embodiment may include an initializing operation may S1410 of initializing the reference voltage line RVL by turning on the driving transistor DRT, the first transistor T1, and the second transistor T2 and applying the reference voltage Vref to the reference voltage line RVL; a tracking operation S1420 of initializing the reference voltage line RVL, and then, turning on the second transistor T2; and a voltage measuring operation S1430 of measuring a voltage of the reference voltage line RVL when a predetermined amount of time has elapsed after the second transistor T2 is turned on.

When the driving method of the organic light-emitting display device 100 is used, it may be possible to accurately detect a short circuit occurring in the OLED.

With reference to FIG. 14, the initializing operation S1410, the tracking operation S1420, and the voltage measuring operation S1430 may be performed on one subpixel SP. After the voltage measuring operation S1430 is performed on each subpixel SP and the initializing operation S1410, the tracking step S1420, and the voltage measuring operation S1430 are performed on all of the subpixels SP, it may be determined in operation S1440 whether or not a short circuit has occurred in the OLED of a corresponding subpixel, based on a voltage measurement value obtained with respect to the corresponding subpixel. When it is determined that the short circuit has occurred in the OLED, the corresponding subpixel may be regarded being a defective subpixel and subpixel information (e.g., position information or identification information) about the corresponding subpixel may be stored in the memory 530 (e.g., in operation S1440).

Alternatively, after all of the initializing operation S1410, the tracking operation S1420, and the voltage measuring operation S1430 are performed on each of the subpixels SP, it may be determined whether a short circuit has occurred in an OLED of each subpixel, based on a voltage measurement value obtained with respect to each subpixel, and information (for example, position information or identification information) on a defective subpixel, in which the short circuit of the OLED is determined to be generated, may be stored in the memory 530 (e.g., in operation S1440).

Figure 15:
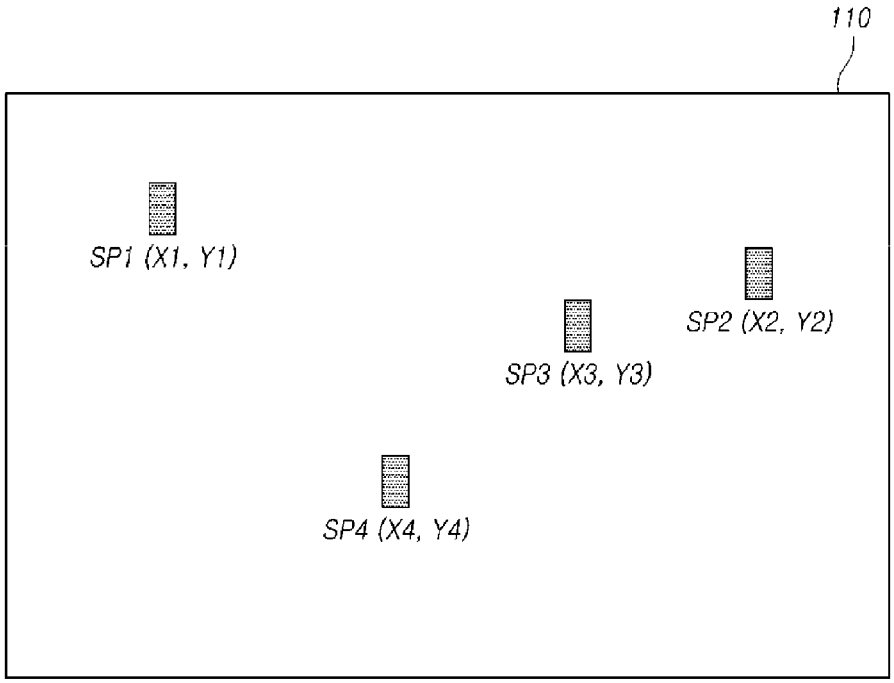
FIG. 15 is a diagram illustrating positions of subpixels in which a short circuit has occurred in an OLED according to an OLED short detection result of an organic light-emitting display device according to an example embodiment.

FIG. 15 is a diagram illustrating positions of subpixels in which a short circuit has occurred in an OLED according to an OLED short detection result of an organic light-emitting display device according to an example embodiment.

Figure 16:
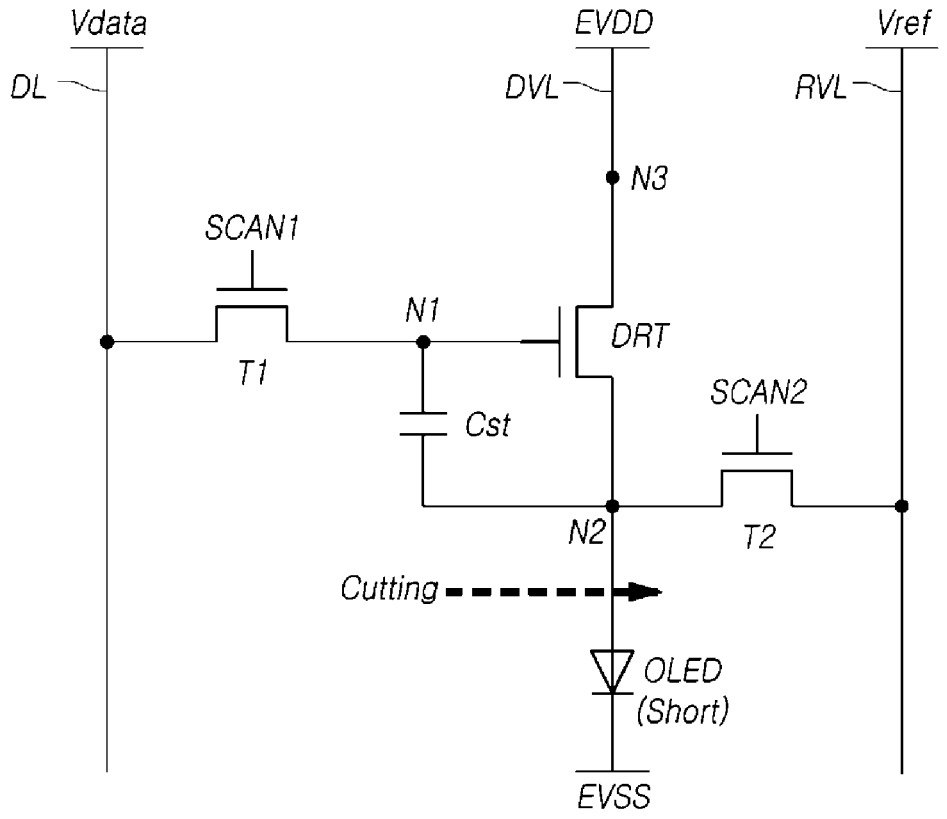
FIGS. 16 and 17 are diagrams illustrating a repair processing method with respect to subpixels in which a short circuit has occurred in an OLED according to an OLED short detection result of an organic light-emitting display device according to an example embodiment.
Figure 17:
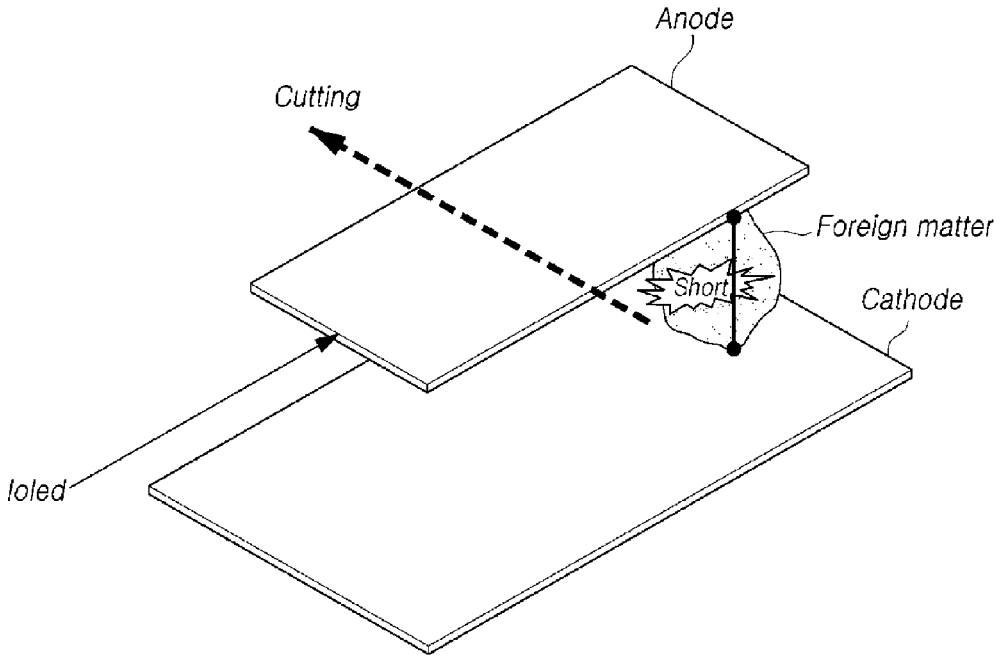

FIGS. 16 and 17 are diagrams illustrating a repair processing method with respect to subpixels in which a short circuit has occurred in an OLED according to an OLED short detection result of an organic light-emitting display device according to an example embodiment.

As shown in the FIG. 15 example, as the OLED short detection result, when pieces of position information, e.g., (X1, Y1), (X2, Y2), (X3, Y3), and (X4, Y4), on four defective subpixels SP1, SP2, SP3, and SP4 may be stored in the memory 530, a subpixel in which a short circuit has occurred in an OLED of the organic light-emitting display device 100 may be confirmed with reference to the pieces of position information about the defective subpixels stored in the memory 530. Accordingly, repair processing may be performed on the confirmed subpixel. Embodiments are not limited to the four subpixels illustrated in the example.

As shown in the FIG. 16 example, the repair processing may include cutting at a location between the second node N2 of the driving transistor DRT and the first electrode of the OLED, e.g., through a laser cutting processing method. In addition, as shown in the FIG. 17 example, when the first electrode is an anode and the second electrode is a cathode, the repair processing may include cutting the first electrode to which a driving current is applied, e.g., through a laser cutting process method. The cut point may be a location to which a driving voltage EVDD is applied, and may be any location able to inhibit a current from flowing into an OLED in which a short circuit has occurred between a first electrode and a second electrode of the OLED.

According to an example embodiment as described above, it may be possible to provide the organic light-emitting display panel 110, the organic light-emitting display device 100, the driving circuit 1200, the controller 140, and the driving method, which may be able to detect whether the short circuit has occurred between the first electrode and the second electrode of the OLED. In addition, according to an example embodiment, it may be possible to provide the organic light-emitting display panel 110, the organic light-emitting display device 100, the driving circuit 1200, the controller 140, and the driving method, which may be able to accurately distinguish and detect whether the short circuit has occurred in the OLED, regardless of a short circuit occurring in other circuit devices (for example, the driving transistor DRT and the like).

Furthermore, according to an example embodiment, it may be possible to provide the organic light-emitting display panel 110, the organic light-emitting display device 100, the driving circuit 1200, the controller 140, and the driving method, which may be able to accurately determine a position to be repaired in an organic light-emitting display panel by storing and updating information (for example, identification information or position information) on a subpixel in which a short circuit has occurred in an OLED.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. An organic light-emitting display device, comprising:
an organic light-emitting display panel comprising:
a plurality of data lines;
a plurality of gate lines;
a plurality of subpixels at respective intersections of the plurality of data lines and the plurality of gate lines, each of the plurality of subpixels comprising:
an organic light-emitting diode (OLED);
a driving transistor driving the OLED comprising:
a first node for a data voltage to be applied;
a second node electrically connected to a first electrode of the OLED; and
a third node for a driving voltage to be applied though a driving voltage line;
a first transistor electrically connected between the first node of the driving transistor and a corresponding data line among the plurality of data lines; and
a second transistor electrically connected between the second node of the driving transistor and a reference voltage line to which a reference voltage is applied;
a sensor configured to measure a voltage of the reference voltage line; and
a sampling switch electrically connected between the reference voltage line and the sensor,
wherein, during an OLED short detection period in which a short circuit occurring between the first electrode and a second electrode of the OLED is detected:
the driving transistor and the first transistor are configured to be in an off state,
in a state in which the second transistor is turned off, the reference voltage line is configured to be initialized in response to the reference voltage being applied thereto,
after the reference voltage line is initialized, after a predetermined amount of time has elapsed after the second transistor is turned on, the sampling switch is configured to be turned on to electrically connect the sensor and the reference voltage line, and
the sensor is configured to measure the voltage of the reference voltage line.

2. The organic light-emitting display device of claim 1, wherein:
the driving voltage during the OLED short detection period has a second driving voltage value lower than a first driving voltage value during a display period;
a base voltage during the OLED short detection period has a second base voltage value higher than a first base voltage value during the display period; and
the reference voltage during the OLED short detection period has a voltage value lower than the second base voltage value.

3. The organic light-emitting display device of claim 1, wherein the OLED short detection period proceeds according to generation of a power-off signal.

4. The organic light-emitting display device of claim 1, further comprising a reference voltage supply control switch electrically connected between a reference voltage supply node and the reference voltage line.

5. The organic light-emitting display device of claim 4, wherein:
the OLED short detection period is time-divided into an initialization period, a tracking period, and a detection period;
during the initialization period, the reference voltage supply control switch is configured to be turned on to initialize the reference voltage line to the reference voltage in a state in which the driving transistor, the first transistor, and the second transistor are turned off;
during the tracking period, the second transistor is configured to be turned on to maintain the second transistor in a turned on state for a predetermined amount of time in a state in which the reference voltage supply control switch is turned off;
during the detection period, the sampling switch is configured to be turned on to electrically connect the sensor and the reference voltage line; and
the sensor is further configured to measure the voltage of the reference voltage line to output a voltage measurement value.

6. The organic light-emitting display device of claim 5, further comprising a detector configured to:
detect, based on the voltage measurement value, whether the short circuit has occurred between the first electrode and the second electrode of the OLED;
determine that the short circuit has not occurred between the first electrode and the second electrode of the OLED based on a determination that the voltage measurement value is equal to the reference voltage or is within a critical range of the reference value; and
determine that the short circuit has occurred between the first electrode and the second electrode of the OLED based on a determination that the voltage measurement value is different from the reference voltage, is higher than the reference voltage, or deviates from the critical range of the reference value.

7. The organic light-emitting display device of claim 6, wherein, based on a determination that the voltage measurement value is different from the reference voltage, is higher than the reference voltage, or deviates from the critical range of the reference value, the detector is further configured to:
store identification information or position information about at least one subpixel among the plurality of subpixels, in which the short circuit has occurred between the first electrode and the second electrode of the OLED, in a memory; or
output a message indicating that the short circuit has occurred between the first electrode and the second electrode of the OLED.

8. An organic light-emitting display panel, comprising:
a plurality of data lines;
a plurality of gate lines;
a plurality of subpixels at respective intersections of the plurality of data lines and the plurality of gate lines, each of the plurality of subpixels comprising:
an organic light-emitting diode (OLED);
a driving transistor driving the OLED comprising:
a first node for a data voltage to be applied;

a second node electrically connected to a first electrode of the OLED; and a third node for a driving voltage to be applied though a driving voltage line;

a first transistor electrically connected between the first node of the driving transistor and a corresponding data line among the plurality of data lines; and a second transistor electrically connected between the second node of the driving transistor and a reference voltage line to which a reference voltage is applied, wherein, during an OLED short detection period in which a short circuit occurring between the first electrode and a second electrode of the OLED is detected:

the driving transistor and the first transistor are configured to be in an off state, in a state in which the second transistor is turned off, the reference voltage line is configured to be initialized in response to the reference voltage being applied thereto, after the reference voltage line is initialized, after a predetermined amount of time has elapsed after the second transistor is turned off, the second transistor is turned on.

9. The organic light-emitting display panel of claim 8, wherein, after the second transistor is turned on, in at least one subpixel among the plurality of subpixels, a voltage of the reference voltage line is different from the reference voltage, is higher than the reference voltage, or deviates from a critical range of the reference voltage.

10. The organic light-emitting display panel of claim 8, wherein, after the second transistor is turned on, in at least one subpixel among the plurality of subpixels, a voltage of the reference voltage line is equal to the reference voltage or is within a critical range of the reference voltage.

11. The organic light-emitting display panel of claim 8, wherein:

the driving voltage during the OLED short detection period has a second driving voltage value lower than a first driving voltage value during a display period;

a base voltage during the OLED short detection period has a second base voltage value higher than a first base voltage value during the display period; and the reference voltage during the OLED short detection period has a voltage value lower than the second base voltage value.

12. A driving circuit for driving an organic light-emitting display panel comprising a plurality of subpixels, comprising an organic light-emitting diode (OLED) including first and second electrodes and a driving transistor for driving the OLED, the driving circuit comprising:

a first circuit configured to output a first data voltage to a data line during a first period and a second data voltage to the data line during a second period different from the first period;

a second circuit configured to output a driving voltage having a first driving voltage value to a driving voltage line electrically connected to a drain node or a source node of the driving transistor during the first period and the driving voltage having a second driving voltage value lower than the first driving voltage value to the driving voltage line during the second period;

a third circuit configured to output a base voltage applied to the second electrode of the OLED as a first base voltage value during the first period and the base voltage having a second base voltage value higher than the first base voltage value during the second period; and a fourth circuit configured to output a reference voltage having a voltage value lower than the second base voltage value to a reference voltage line during the second period, the reference voltage line being connectable to the source node or the drain node of the driving transistor though other transistors.

13. The driving circuit of claim 12, wherein:

the first period is a display driving period; and the second period is a driving period for detecting a short circuit occurring between the first electrode and the second electrode of the OLED.

14. A method of driving an organic light-emitting display device comprising an organic light-emitting display panel comprising a plurality of subpixels defined by intersections of a plurality of data lines and a plurality of gate lines, the method comprising:

initializing a reference voltage line by:

turning off a driving transistor driving an organic light-emitting diode (OLED) of a subpixel, a first transistor electrically connected between a first node of the driving transistor and a data line among the plurality of data lines, and a second transistor electrically connected between a second node of the driving transistor and the reference voltage line;

applying a reference voltage to the reference voltage line;

turning on the second transistor after initializing the reference voltage line; and measuring a voltage of the reference voltage line after a predetermined amount of time has elapsed after the second transistor is turned on.

15. A controller for controlling driving of an organic light-emitting display panel, the controller comprising:

a first driving controller, in a state in which a driving transistor driving an organic light-emitting diode (OLED) of a subpixel, the first driving controller comprising:

a first transistor electrically connected between a first node of the driving transistor and a data line; and a second transistor electrically connected between a second node of the driving transistor and the reference voltage line are turned off, wherein the first driving controller is configured to control a reference voltage line to be initialized to a reference voltage;

a second driving controller configured to control the second transistor to be turned on after the reference voltage line is initialized; and a third driving controller configured to control a voltage of the reference voltage line to be measured when a predetermined amount of time has elapsed after the second transistor is turned on.

16. The controller of claim 15, further comprising a detector configured to:

detect a short circuit occurring between a first electrode and a second electrode of the OLED;

determine that the short circuit has not occurred between the first electrode and the second electrode of the OLED, based on a determination that the voltage measurement value is equal to the reference voltage or is within a critical range of the reference value; and determine that the short circuit has occurred between the first electrode and the second electrode of the OLED, based on a determination that the voltage measurement value is different from the reference voltage, is higher than the reference voltage, or deviates from the critical range of the reference value.

17. The controller of claim 16, wherein, based on a determination that the voltage measurement value is different from the reference voltage, is higher than the reference voltage, or deviates from the critical range of the reference value, the detector is further configured to:

store identification information or position information about the subpixel, in which the short circuit has occurred between the first electrode and the second electrode of the OLED, in a memory; or output a message indicating that the short circuit has occurred between the first electrode and the second electrode of the OLED.

18. An organic light-emitting display device, comprising:

an organic light-emitting display panel comprising:

a plurality of data lines;

a plurality of gate lines;

a plurality of subpixels at respective intersections of the plurality of data lines and the plurality of gate lines;

a data driver configured to drive the plurality of data lines; and a gate driver configured to drive the plurality of gate lines, wherein each of the plurality of subpixels comprises:

an organic light-emitting diode (OLED), a driving transistor driving the OLED comprising:

a first node for a data voltage to be applied, a second node electrically connected to a first electrode of the OLED, and a third node for a driving voltage to be applied though a driving voltage line, a first transistor electrically connected between the first node of the driving transistor and a corresponding data line among the plurality of data lines, and a second transistor electrically connected between the second node of the driving transistor and a reference voltage line to which a reference voltage is applied, wherein the driving voltage has:

a first driving voltage value during a first period, and a second driving voltage value lower than the first driving voltage value during a second period different from the first period, a base voltage has:

a first base voltage value during the first period, and a second base voltage value higher than the first base voltage value during the second period, and the reference voltage has a voltage value lower than the second base voltage value during the second period.

* * * * *